United States Patent [19]

Eskeli

[11] 4,003,673

[45] Jan. 18, 1977

[54] FLUID PRESSURIZER

[76] Inventor: Michael Eskeli, 7994-41 Locke Lee, Houston, Tex. 77042

[22] Filed: Apr. 17, 1975

[21] Appl. No.: 568,895

Related U.S. Application Data

[63] Continuation-in-part of Ser. No. 386,273, Aug. 7, 1973, Pat. No. 3,758,223, and a continuation-in-part of Ser. No. 185,060, Sept. 30, 1971, Pat. No. 3,879,152.

[52] U.S. Cl. ..... 415/80

[51] Int. Cl.[2] ..... F01D 1/18

[58] Field of Search ..... 415/80

[56] References Cited

UNITED STATES PATENTS

| | | | |
|---|---|---|---|
| 742,423 | 10/1903 | Hedlund | 415/80 |
| 1,108,497 | 8/1914 | Gridley | 415/80 |
| 3,748,054 | 7/1973 | Eskeli | 415/80 |
| 3,758,223 | 9/1973 | Eskeli | 415/80 |
| 3,828,553 | 8/1974 | Eskeli | 415/80 |
| 3,879,152 | 4/1975 | Eskeli | 415/80 |

*Primary Examiner*—C. J. Husar

[57] ABSTRACT

A method and apparatus for the pressurizing of fluids wherein a rotor is rotated on a shaft and the rotor is provided with an entry for the fluid at center, a pressurizing cavity with vanes, nozzles discharging the fluid forward, a vortex cavity for pressurizing the fluid, and exit means for passing the fluid from the rotor. Usually a casing is provided for collecting the pressurized fluid with an exit for delivery. The pressurizer can be used to pressurize either liquids or gases. The exit means from the rotor may be nozzles directed to discharge the fluid, or they may be other means for reclaiming part of the kinetic energy of the leaving fluid.

3 Claims, 2 Drawing Figures

FLUID PRESSURIZER

CROSS REFERENCES TO RELATED APPLICATIONS

This application is a continuing-in-part application of "Turbine", filed Aug. 7, 1973, Ser. No. 386,273, now U.S. Pat. No. 3,758,223 and "Reaction Rotor Turbine", filed Sept. 30, 1971, Ser. No. 185,060, now U.S. Pat. No. 3,879,152.

BACKGROUND OF THE INVENTION

This invention relates to fluid pressurizers where centrifugal force is used to increase the pressure of the fluid.

In previous fluid pressurizers of the centrifugal type, fluid is accelerated in the rotor, and then decelerated in the casing producing pressure. These methods are costly in power consumption due to turbulence and friction losses, and for high pressures, the operation may become unstable, which ordinarily is corrected by adding stages, thus increasing the cost of the unit.

SUMMARY OF THE INVENTION

It is an object of this invention to provide a means for pressurizing fluids with a reduced power requirement while still maintaining relatively simple construction for the pressurizer.

BRIEF DESCRIPTION OF THE DRAWINGS

Referring to FIG. 1, therein is shown a cross section of the pressurizer along the shaft. 10 is casing, 11 is rotor, 12 is rotor vortex cavity, 13 are vortex cavity exit openings, 14 is fluid exit from casing, 15 are vortex cavity feeder nozzles, 16 is pressurizing cavity, 17 is fluid entry, 18 are vanes, 19 is bearing and seal for shaft 20.

In FIG. 2, 10 is casing, 16 is pressurizing cavity, 18 are vanes, 20 is shaft, 15 are vortex cavity entry nozzles, 12 is vortex cavity, 13 are vortex cavity exit openings, 11 is rotor.

Figure 2:
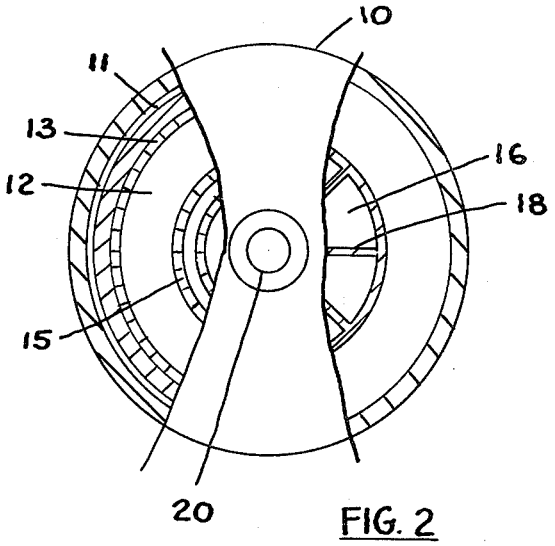
FIG. 2 is an end view of the pressurizer with sections removed to show internal details.

In operation, fluid enters via entry 17 into rotor cavity 16, where it is preliminarily pressurized by centrifugal force with vanes 18 assuring that the fluid will rotate with the rotor 11. The fluid then passes via nozzles 15 forwardly in the direction of rotation into vortex cavity 12, thus adding the fluid exit velocity from the nozzles to the tangential velocity of the nozzles which is due to the rotation of the rotor, and there the fluid is pressurized by centrifugal force due to the fluid being forced to follow a curved path, with higher pressure occurring at the periphery of the said vortex cavity. After pressurization, the fluid is passed from the vortex cavity via openings 13 into casing 10, and from there into exit opening 14. The openings 13 may be plain holes, or they may be orifices arranged to discharge the fluid backward away from the direction of rotation. The rotor is rotated, with power supplied to shaft 20.

The fluid being pressurized may be either a liquid or a gas, or a liquid-gas mixture.

Figure 1:
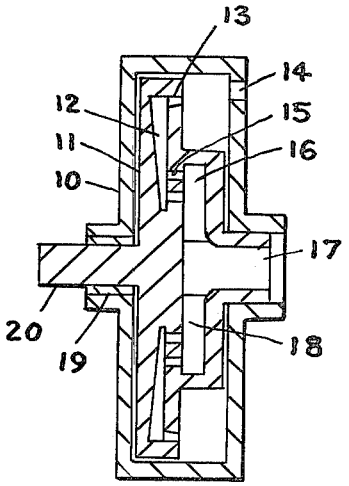
FIG. 1 is a cross section of the pressurizer.

In normal operation, the pressure at the area nearest to the rotor center of cavity 12 is usually zero. This pressure may be higher, as desired. Thus, the fluid velocity within the vortex cavity downstream of nozzles 15 is the sum of fluid velocity leaving said nozzles relative to rotor, and the rotor velocity. In FIG. 1, two rows of nozzles 15 are shown, more or less rows may be used as desired. Generally, additional nozzle rows will give better control of fluid tangential velocity within vortex cavity 12, thus improving the pressure gain for the pump or compressor.

The shape of the vortex cavity in cross section is shown to be almost triangular. This shape is usually used to control the amount of times that the fluid will have to travel around the vortex cavity. It is generally desirable to limit the number of trips the fluid circulates around the vortex cavity to reduce fluid friction losses. In model studies, it has been desirable to limit these trips to one; that is, the fluid traveling but once around the vortex cavity before discharge from openings 13. The shape of said cavity may be made as desired, to suit the fluid being pressurized, and the amount of pressure gain desired.

The entry pressure of the fluid at the entry 17, may be as desired. As is common with pumps and compressors, there is normally some pressure at entry, such as the pressure of the atmosphere. The performance of the pressurizer of this invention is generally improved with an increase in entry pressure, so that this device is particularly useful as a pressure booster.

The rotor of this pressurizer may be attached to another rotor or two rotors be built together, to form a multistage unit. Such arrangements are particularly desirable where the entry pressure of the fluid entering at 17 is low, while a high fluid exit pressure is required. Obviously, more than two stages may be used, if desired.

The openings 13 may be nozzles arranged to discharge the fluid backward, to reduce work input to rotor. Such is often desirable, as can be readily shown; the following example illustrates this point: Using water as the fluid, a pressure drop of 3 psia produces, when this pressure drop is from nozzle entry to nozzle exit, an exit velocity of 21 FPS, and thus for a small pressure loss at the openings 13 can reduce significantly the work input to the rotor.

In an alternate arrangement, the openings 13 may discharge into an adjacent second rotor mounted concentric with the rotor of the pressurizer, with vanes or buckets being used to convert the kinetic energy of the fluid leaving openings 13, to work. Also, an inward flow type turbine could be used to convert the kinetic energy to work, if desired.

I claim:

1. A fluid pressurizer comprising a shaft mounted for rotation, a rotor mounted on said shaft so as to rotate therewith, a casing enclosing the rotor said rotor having an entry for a fluid to be pressurized near its center, said rotor having a first cavity concentric with said shaft communicating with said entry for passage of said fluid and having a set of vanes, said first cavity having a set of feeder nozzles for discharging said fluid in a direction that is forwardly and in the direction of rotation into a second cavity, said second cavity being a radially outward cavity concentric with said shaft, said fluid being pressurized within said second cavity by centrifugal force acting on said fluid, said fluid being then discharged from said second cavity into the casing through a set of exit openings located near to the outer radius of said second cavity, said fluid pressurizer having an outlet through which the fluid in the casing may flow from the pressurizer.

2. The pressurizer of claim 1 wherein said set of exit openings are a set of nozzles sized and shaped to accelerate said fluid being discharged from said second cavity.

3. The pressurizer of claim 1 wherein said set of exit openings are a set of nozzles arranged to discharge said fluid in a direction that is away from the direction of rotation.

* * * * *